US005607077A

United States Patent [19]

Torkelson

[11] Patent Number: 5,607,077

[45] Date of Patent: Mar. 4, 1997

[54] FOOD BEVERAGE AND ACCESSORIES PLATE

[76] Inventor: Torkel E. Torkelson, 1961 River Reach Dr. Suite 207, Naples, Fla. 33942

[21] Appl. No.: 645,913

[22] Filed: May 14, 1996

Related U.S. Application Data

[63] Continuation of Ser. No. 234,589, Apr. 21, 1994, abandoned, which is a continuation of Ser. No. 1,097, Jan. 6, 1993, abandoned, which is a continuation-in-part of Ser. No. 698,901, May 13, 1991, abandoned.

[51] Int. Cl.[6] ..... A47G 19/00

[52] U.S. Cl. ..... 220/575; 220/556; 220/735; 220/737; 206/217; 206/542; 206/549; D7/543; D7/546; D7/549; D7/553; D7/555

[58] Field of Search ..... 220/23.8, 23.83, 220/23.86, 555, 556, 575, 735, 737, 739; 206/217, 542, 549; D7/543, 544, 546, 549, 553, 555; 215/56

[56] References Cited

U.S. PATENT DOCUMENTS

| | | | |
|---|---|---|---|
| D. 162,860 | 4/1951 | Mercer | D7/544 |
| D. 182,396 | 4/1958 | Berry, Jr. | D7/549 |
| D. 290,919 | 7/1987 | Beute | D7/543 |
| D. 296,404 | 6/1988 | Lowerbein | D7/553 |
| D. 305,192 | 12/1989 | Van Erkel | D7/553 X |
| 1,957,263 | 5/1934 | Gray | 215/100.5 |
| 2,727,645 | 12/1955 | Dore | 215/100.5 |
| 2,929,526 | 3/1960 | Steinberg | 215/100.5 |
| 2,990,968 | 7/1961 | Pirman | 215/100.5 |
| 3,018,014 | 1/1962 | Opolion | 215/100.5 |
| 3,148,636 | 9/1964 | Bloomquist et al. | D7/553 X |
| 3,498,470 | 3/1970 | Thomas | 220/575 X |
| 3,656,681 | 4/1972 | Goings | 220/23.8 X |
| 4,607,758 | 8/1986 | Stevens | 220/23.83 |
| 4,867,331 | 9/1989 | Task | 220/23.8 |
| 4,938,373 | 7/1990 | McKee | 220/23.86 |
| 4,991,713 | 2/1991 | Phillips | 206/218 |

FOREIGN PATENT DOCUMENTS

| | | | |
|---|---|---|---|
| 398273 | 11/1990 | European Pat. Off. | 220/556 |
| 3841770 | 6/1990 | Germany | 220/575 |
| 255643 | 7/1926 | United Kingdom | 220/23.8 |
| 266528 | 3/1927 | United Kingdom | 220/23.8 |
| 553089 | 5/1943 | United Kingdom | 220/575 |
| 1126304 | 9/1968 | United Kingdom | D7/549 |

*Primary Examiner*—Stephen K. Cronin
*Attorney, Agent, or Firm*—Merrill N. Johnson

[57] ABSTRACT

A hand-held, self-contained support plate for carrying or serving foods and beverages and for carrying accessories such as utensils, toothpicks, and napkins is disclosed. The plate includes a planar support surface into which are recessed a main compartment and side compartment for receiving foods, a sauce compartment for receiving sauces, condiments, and the like, and a beverage compartment having a raised peripheral edge for increasing support for the beverage container. The plate includes an aperture through which the user inserts a thumb to grip the plate, the aperture being placed so as to enable the user to avoid harmful contact with hot or cold materials supported by the plate and to allow a knuckle of the index finger of the hand to support the beverage container compartment and promote stability of the plate. The plate further includes holes into which toothpicks may be inserted to be held until used and a slot in the peripheral edge of the planar support surface into which napkins may be removably placed. The plate also includes a slot vertically disposed in the plate into which utensils may be inserted to be held until required for use.

18 Claims, 3 Drawing Sheets

FIG. 2
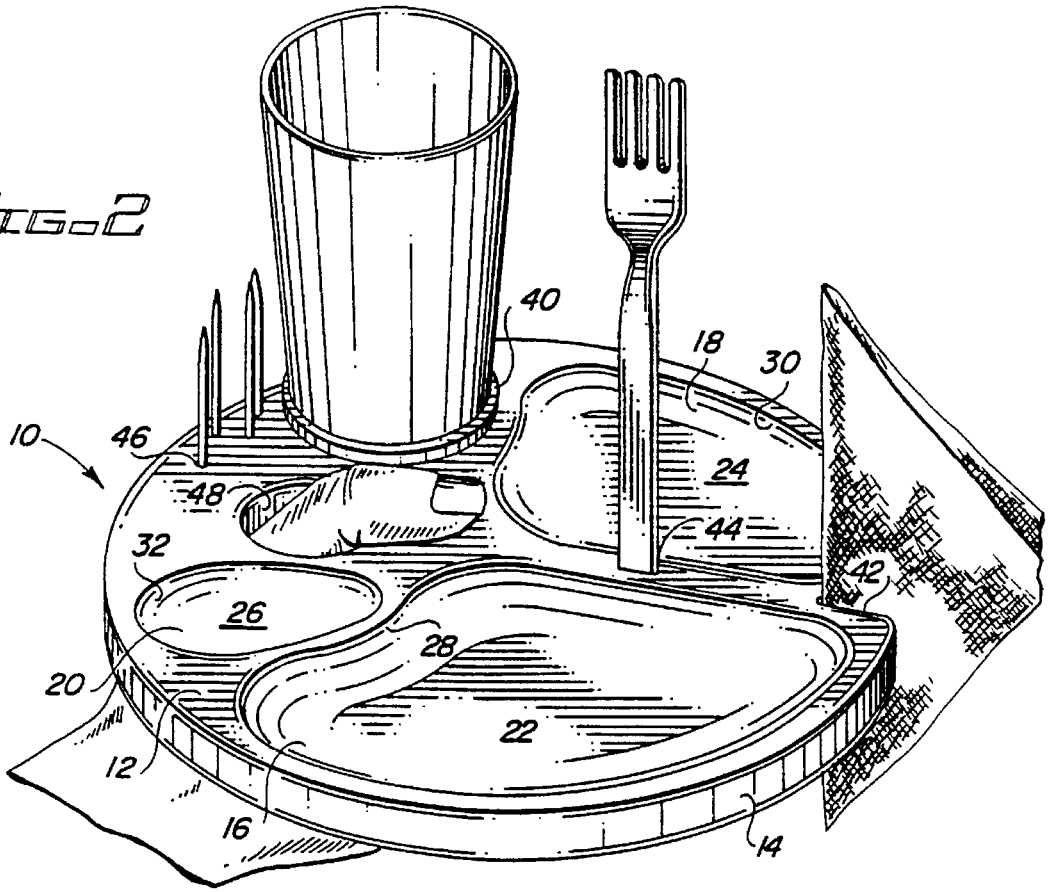
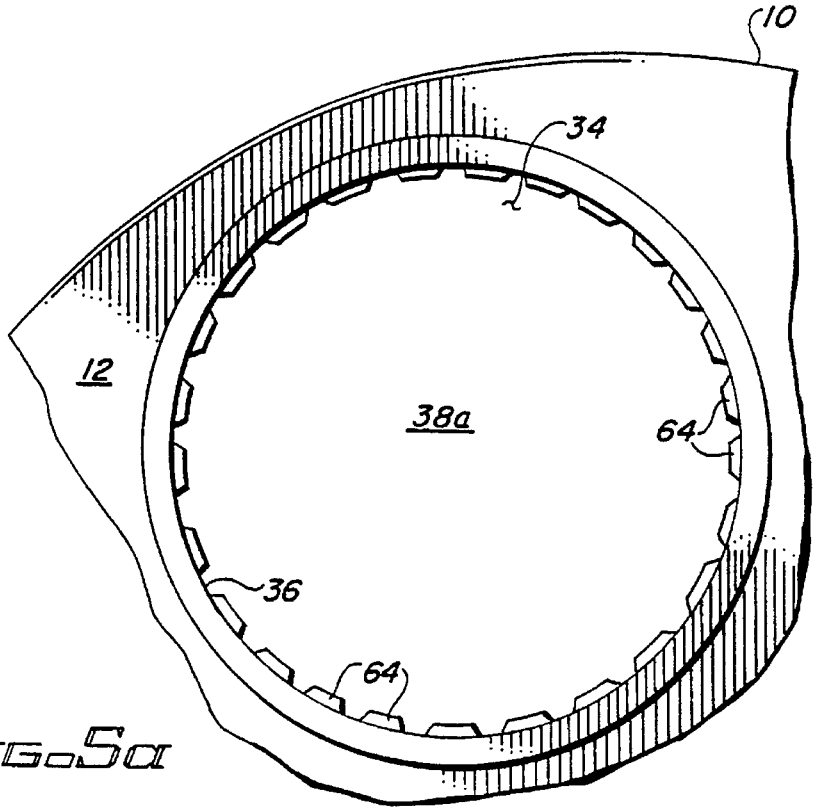
FIG. 5a

FOOD BEVERAGE AND ACCESSORIES PLATE

RELATED APPLICATION

This application is a file wrapper continuation of application Ser. No. 08/234,589, filed Apr. 21, 1994, now abandoned which is a file wrapper continuation of application Ser. No. 08/001,097, filed Jan. 6, 1993, now abandoned, which is a continuation-in-part of application Ser. No. 07/698,901, filed May 13, 1991, abandoned.

FIELD OF THE INVENTION

The present invention relates generally to hand-held support plates for the carrying or serving of foods and beverages. More particularly, it relates to a self-contained, hand-held support for foods, a beverage container, and accessories such as utensils, toothpicks and napkins, which is especially advantageous for party or picnic uses.

BACKGROUND OF THE INVENTION

Various service trays and plates in the art have attempted to provide means for supporting food and beverages manually, especially in situations such as cocktail parties and picnics wherein the consumer often stands and moves about while eating and drinking. U.S. Pat. No. 4,461,396 to Harper, for example, discloses a simple plate having partitions for separating various foods and an area adjacent a thumb hole in which a beverage container of the stem type is placed, the flat base of the beverage container being gripped between the plate surface and the user's thumb. Such an arrangement has disadvantages, including that containers other than the stem type, such as simple paper cups, cannot be used because the user's thumb cannot be positioned so as to grip the cup, and the thumb in such a situation would not provide the stability needed to prevent upset of the plate surface and its contents. The Harper plate also has the disadvantage of not providing for the inclusion of means for holding accessories normally needed, such as napkins, utensils, toothpicks and the like. Furthermore, by requiring the user to physically contact the beverage container to provide the necessary stabilization of the container, the Harper device requires the user to contact surfaces whose high or low temperatures may cause discomfort or injury to the user.

Other examples of support devices in the art are shown in U.S. Pat. No. 3,877,603 to Holz; U.S. Pat. No. 4,516,685 to French; U.S. Pat. No. 4,867,331 to Task; and U.S. Pat. No. 4,966,297 to Doty. Each device disclosed in those patents has disadvantages which are overcome by the present invention. For example, the Holz reference includes a rigid base having recesses into which several removable containers are inserted. The need for several containers makes construction of the device complicated and expensive and the lack of means for holding napkins, utensils, toothpicks and the like is disadvantageous. Similar disadvantages are found in the other cited references.

Another disadvantage of devices in the art which include holders for a beverage container is that the user must apply manual or digital pressure to the beverage container in order to stabilize it. This is awkward and stability of the container is not assured. Additionally, as pointed out above, such devices may result in discomfort or injury to the user when the beverage in the container is very cold or very hot.

Devices known in the art that include apertures for insertion of the users thumb or other fingers have yet another disadvantage. By disposing such apertures at or near the peripheral edge of the plate, the stability of the plate containing food and beverage depends on the rigidity of the plate. This is also true for plates which do not include an aperture for the thumb. By contrast, the aperture of the present invention is placed so as to enable the user to support the plate by applying the palm and fingers of the hand to the underside of the plate. The stabilization of the plate and its contents is therefore enhanced.

SUMMARY OF THE INVENTION

The present invention preferably comprises a substantially planar support surface defined by a peripheral edge, the support surface including at least one food compartment recessed in the support surface for containing food, the compartment being defined by a bottom surface and by a peripheral surface having a lower end connected to the bottom surface and an upper end connected to the support surface and a beverage container compartment recessed in the support surface for holding a beverage container, the beverage container compartment being defined by a bottom surface and by a peripheral surface having a lower end connected to the bottom surface and an upper end connected to the support surface. The present invention further includes an aperture disposed substantially vertically through the support surface for receiving a thumb of a hand extended upwardly there through, the aperture being disposed so as to prevent contact by said thumb with the food container and with said beverage container compartment and disposed to enable the user to stabilize the plate by applying the palm and fingers of his hand to the underside of the plate. The plate preferably includes at least one toothpick holding means for holding at least one toothpick, at least one utensil holding means for holding at least one utensil, and at least one napkin holding means for holding at least one napkin.

More particularly described, the present invention includes a plate for supporting foods, beverages and accessories, comprising a substantially planar support surface defined by a peripheral edge, the support surface including a plurality of food compartments recessed in the support surface for containing food, each of the compartments being defined by a bottom surface and by a peripheral surface having a lower end connected to the bottom surface and an upper end connected to the support surface. The plate also includes a beverage container compartment recessed in the support surface for holding a beverage container, the beverage container compartment being defined by a bottom surface and by a peripheral surface having a lower end connected to the bottom surface and an upper end connected to the support surface, the beverage container compartment further preferably including a raised rim extending from the upper end of the peripheral surface of the beverage container compartment substantially vertically upward from the support surface. The plate also includes an aperture disposed substantially vertically through the support surface for receiving a thumb of a hand extended upwardly there through, the aperture being disposed so as to enable the user to avoid harmful contact by the thumb with the food containers and with the beverage container compartment.

A plurality of toothpick holding means for holding a plurality of toothpicks also is preferably included in the plate, as well as at least one utensil holding means for holding at least one utensil. The toothpick holding means includes at least one toothpick compartment recessed in the support surface for receiving at least one toothpick, the toothpick compartment including a bottom surface and a peripheral surface having a lower end connected to the bottom surface and an upper end connected to the support surface. Alternatively, toothpick holding means may include at least one hole disposed substantially vertically through the support surface, the hole being of a diameter sufficient to removably hold at least one toothpick.

Preferably, the utensil holding means including a utensil slot disposed substantially vertically through the support surface, the utensil slot being of a width sufficient to receive at least one utensil and being of a length sufficient to prevent passage of said utensil through the slot. The plate also may include at least one napkin holding means for holding at least one napkin, the napkin holding means including at least one napkin slot substantially vertically disposed in the peripheral edge of the support surface, the napkin slot being of sufficient width to releasably hold at least one napkin therein.

The present invention overcomes the disadvantages of devices in the art. For example, the present invention enables the user to have immediately and conveniently available not only food and beverage to be consumed, but also accessories normally used in food and beverage consumption. Previously, a napkin would have to be held separately by the user, thereby limiting the user's movements. In the present invention, the napkin is clasped in a slot in the support plate so that it is always immediately available for use when needed, yet is not required to be held at other times.

A similar problem existed previously for the utensils to be used. The utensils either had to be held separately by the user or simply placed upon the top of the plate surface. In the latter position, the utensils often slipped into one of the food containers, coating its handle with food. The utensils also often simply fell off the plate. This is particularly likely in the picnic or party cocktail situation wherein the user typically is standing and moving. The present invention overcomes these disadvantages by providing at least one slot in the plate surface, preferably disposed vertically through a partition between food compartments, to receive the utensils.

Another similar problem also existed previously for toothpicks. Often, especially where the food served consists of hors d'oeuvres, toothpicks are used as convenient and disposable means for handling the food items. Previously, the user would have to repeatedly return to a table to obtain additional toothpicks, or would have to hold several in his hand, or would place several toothpicks loosely on the plate surface. The first situation is inconvenient and disruptive to social engagements. The second situation presents the same problems as having hand held utensils, as pointed out above. And the third situation presents the same problems of loss as where utensils must be placed in an unsecured manner on the plate surface.

These and other advantages and objects of the present invention will become more apparent from the description of a preferred embodiment, as understood with reference to the accompanying drawings.

BRIEF DESCRIPTION OF THE DRAWINGS

For a more complete understanding of the present invention and the advantages thereof, reference is now made to the following detailed description taken in conjunction with the accompanying drawings in which:

FIG. 2 is a perspective view from above of a preferred embodiment of the present invention;

FIGS. 5*a* and 5*b* are illustrations of an alternative embodiment of the beverage container compartment having ribbed sides and a convex bottom;

DETAILED DESCRIPTION OF THE INVENTION

Figure 1:
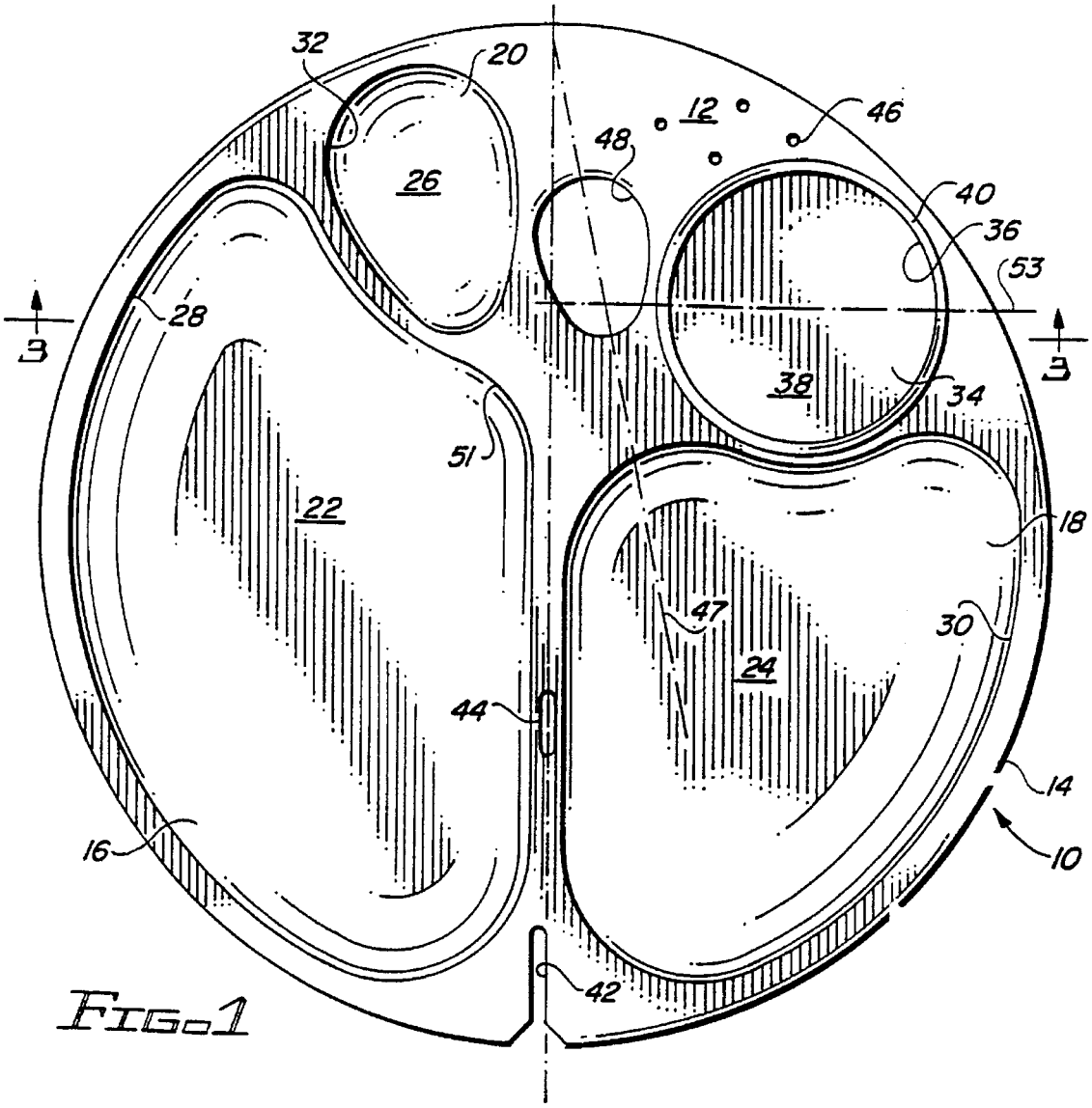
FIG. 1 is a top plan view of a preferred embodiment of the present invention.
Figure 3:
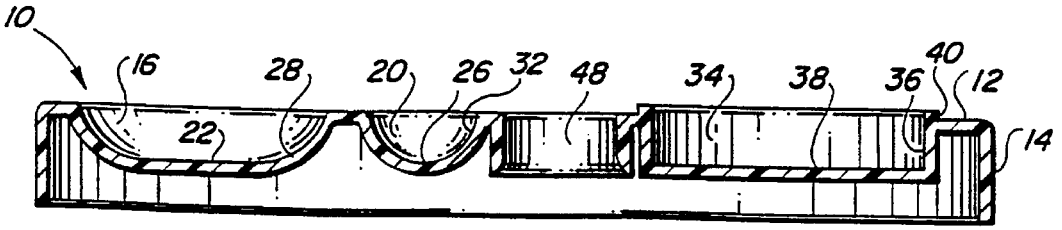
FIG. 3 is a cross-sectional view of a preferred embodiment taken along section line 3—3 of FIG. 1.

The plate of the present invention can be understood with reference to FIG. 1, FIG. 2 and FIG. 3, which show the plate generally as 10. The term "plate" is not restricted to the general meaning of the term as a substantially flat planar surface, but is to be understood as described and used herein. Plate 10 of the present invention may be conveniently formed in one piece, as by vacuum or injection molding, and may be made of any suitable material. For example, disposable materials such as rigidly formed paper or cardboard or plastic can be used, as well as reusable materials such as ceramics, glass, metal, wood, and the like. The shapes shown in the figures are illustrative of a preferred embodiment of the present invention and are not intended to be restrictive to the shapes shown, unless specifically so designated. Equivalents of the shapes shown will be apparent to one skilled in the art pertaining to the invention.

Plate 10 includes means for supporting food, a beverage container and accessories and preferably includes a substantially planar support surface 12 defined by a peripheral edge 14. Support surface 12 is sufficiently thick and sufficiently rigid to prevent bending of plate 10 under the weight of food and beverages placed thereon. Preferably, however, plate 10 is made of a lightweight material for the convenience of the user.

In a preferred embodiment of the present invention, plate 10 includes a main compartment 16 to contain a main food course, a side compartment 18 for containing a side food course and a sauce compartment 20 for containing a sauce or condiment type of food. It is to be understood that plate 10 of the present invention includes at least one such compartment and is not restricted to a specific number of compartments. Compartments 16, 18 and 20 preferably are recessed in and formed continuously with support surface 12. Preferably compartments 16, 18 and 20 are defined by bottom surfaces 22, 24 and 26, respectively, which are formed continuously with inside peripheral surfaces 28, 30 and 32, respectively, which are sufficiently deep to receive and contain food to be consumed by the user.

Plate 10 of the present invention preferably includes a beverage container compartment 34 recessed in support surface 12 of plate 10 and defined by peripheral surface 36 formed continuously with a bottom surface 38. Preferably, beverage container compartment 34 is recessed in support surface 12 to a sufficient depth to provide stability to the beverage container to be placed therein and prevent tipping of the container.

Preferably, peripheral surface 36 of beverage compartment 34 includes raised rim 40 continuous with peripheral surface 36 and support surface 12. Raised rim 40 extends vertically upward from support surface 12 sufficiently to provide additional stabilization of the beverage container to be place therein to prevent tipping of the container.

Plate 10 of the present invention preferably includes means for holding at least one napkin which may include at least one napkin slot 42 substantially vertically disposed in peripheral edge 14 of support surface 12. As shown in FIG. 2, a napkin may be inserted into napkin slot 42 to be removably held there until needed by the user of plate 10. The napkin may be reinserted into napkin slot 42 after use. Napkin slot 42 preferably is of a width sufficient to receive more than one napkin, yet is sufficiently narrow so as to provide enough gripping force to maintain a single napkin in position therein. A napkin is therefore always available to the user of the present invention, yet is not required to be held separately by the user.

Plate 10 of the present invention also preferably includes utensil holding means which may include utensil slot 44 vertically disposed through support surface 12 of plate 10. Although utensil slot 44 may be disposed at any convenient location in plate 10, it may advantageously be disposed as shown between main compartment 16 and side compartment 18. Utensil slot 44 may be of a width sufficient to receive only one utensil or of a width sufficient to receive more than one utensil. The length of utensil slot 44 is such that the top portion of a utensil, such as the wide end of a fork or spoon, is prevented from slipping through utensil slot 44. It is to be understood that the present invention may include a plurality of utensil slots 44 to accommodate a plurality of utensils.

Plate 10 of the present invention also preferably includes toothpick holding means which may include at least one and preferably a plurality of toothpick holders 46 in support surface 12. Toothpick holders 46 may be holes disposed through support surface 12 of sufficiently small diameter to receive and releasably hold toothpicks, yet not allow the toothpicks to fall through the holes. Alternatively, toothpick holders 46 may include recessed compartments of small diameter and having a bottom connected to peripheral surfaces defining a cylinder to receive at least one toothpick.

Plate 10 of the present invention also preferably includes a thumb aperture 48 disposed through support surface 12 such that the thumb of a user may be inserted up through aperture 48 from the bottom of plate 10 and contact support surface 12 to provide positional stability of plate 10. Preferably, thumb aperture 48 is disposed as shown in the figures between sauce compartment 20 and beverage container compartment 34 such that the longitudinal axis 47 of the aperture 48 is angularly displaced from the longitudinal axis 51 of the plate 10 and support surface 12. The angular displacement will be such that when the thumb of the hand is properly inserted through the aperture 48, the knuckle of the index finger of the hand will support the beverage container compartment 34 10 and stabilize the plate 10. The axis 53 of the beverage container compartment 34 is displaced 90° from the axis 51 and angularly displaced from the longitudinal axis 47 of the aperture 48.

The configuration of the described preferred embodiment enables the user to stabilize the plate 10 by supporting the heavier beverage container compartment with the knuckle of the index finger. The stability created by the placement of the knuckle of the index finger also substantially reduces the torsional forces on the arm of the user holding the tray and reduces the amount of downward pressure that must be applied by the thumb on support surface 12 to stabilized the tray. The configuration further avoids direct physical contact between the thumb and the compartments 16, 18 and 20 and with beverage container compartment 34.

Figure 4A:
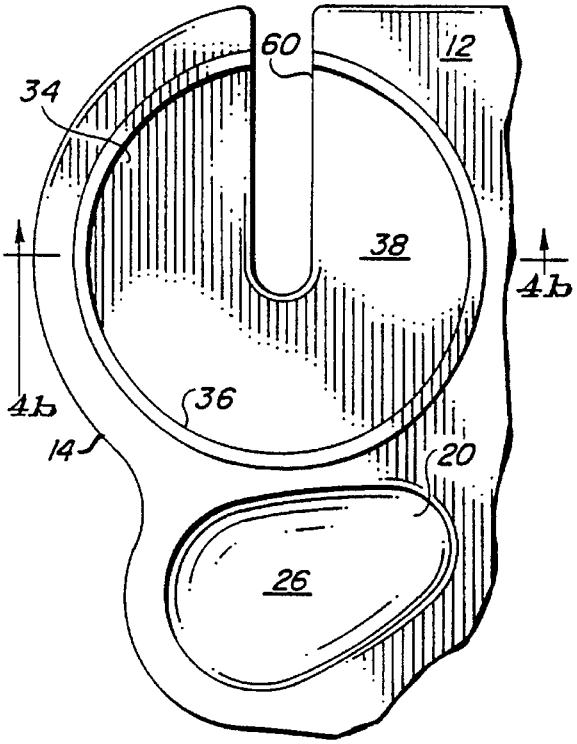
FIGS. 4*a* and 4*b* are illustrations of an alternative embodiment of the beverage container compartment containing a slot for stem type beverage containers.
Figure 4B:
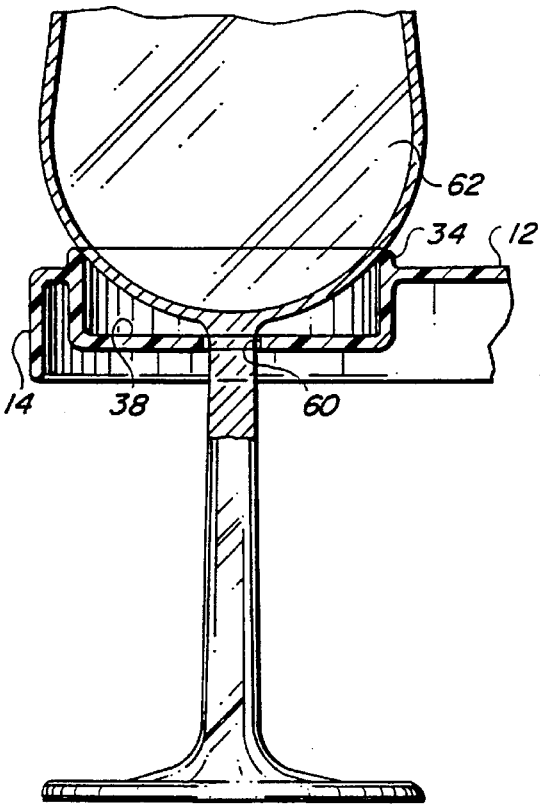

Referring now to FIGS. 4*a* and 4*b*, there is illustrated an alternative embodiment of the beverage container compartment 34. In this embodiment, the beverage container compartment 34 has a slot 60 passing substantially vertically through the peripheral surface 36 and the bottom surface 38. The slot 60 will extend substantially to the center of the bottom surface 38. The stem of a stem type beverage glass 62 is inserted into the slot 60 allowing the stemware to be held by the beverage container compartment as illustrated in FIG. 4*b*.

Figure 5B:
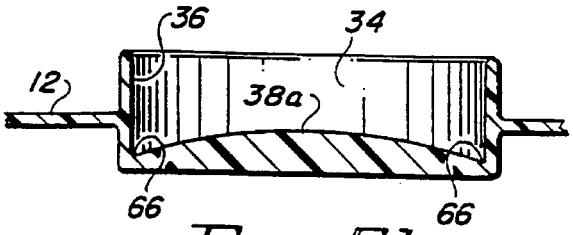

Referring now to FIGS. 5*a* and 5*b*, there is illustrated yet another embodiment of the beverage container compartment 34. The beverage container compartment 34 may further include a plurality of ribs 64 placed along the interior of peripheral surface 36. The ribs 64 allow for a tighter fit between a container and the compartment 34 but dispense enough suction forces to allow easy removal of the container.

The bottom surface 38*a* of the beverage container compartment 34 has a convex shape as shown in FIG. 5*b*. The convex shape allows moisture and condensation to flow to the outer ring area 66. This leaves the bottom of a container relatively dry and drip free when it is removed from the beverage container compartment 34.

Figure 6:
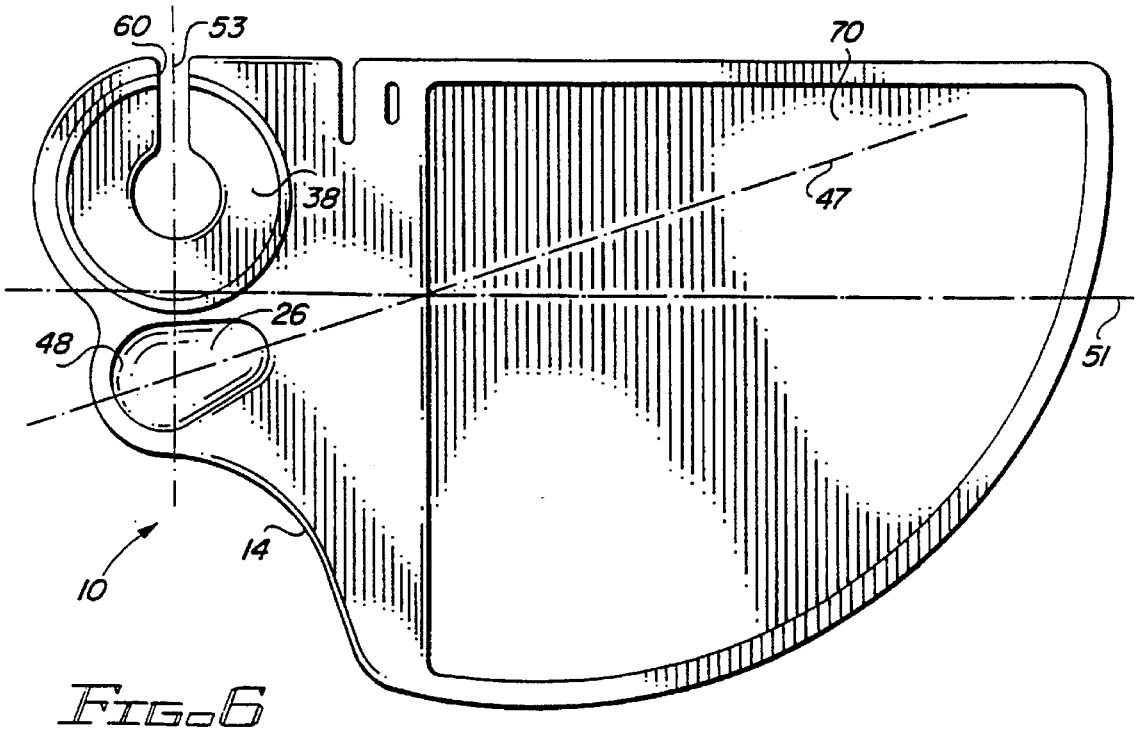
FIG. 6 is an illustration of one alternative embodiment of the tray of the present invention.

Referring now to FIG. 6, there is shown an alternative embodiment of the invention wherein the tray 10 contains a single beverage container compartment 38 and a single wedge shaped food compartment 70. The food compartment 70 may be additionally divided into smaller compartments by the addition of peripheral surfaces.

The angular displacement of the axis 47,51 and 53 are as described with reference to FIG. 1.

The present invention overcomes the disadvantages of other devices in the prior art and provides additional advantages to the user, as shown by the foregoing description. It will be apparent to one skilled in the art pertaining to the invention that various changes and alternative configurations may be made to the embodiment describe above with reference to the accompanying drawings without departing from the spirit and scope of the invention. The scope of the present invention is to be limited only by the appended claims.

I claim:

1. A three dimensional plate designed to hold items of food and beverage and to be held in one hand of an adult person, said plate having (1) a flat planar upper surface which surface is broken by at least one food depression in the plate for holding items of food and one cylindrical flat bottomed container depression sized to firmly hold a container of liquid refreshment, and (2) a thumb hole located closely adjacent to the container depression, said thumb hole sized and oriented to receive from below the plate the thumb of the hand of an adult person so that the largest knuckle of the person's index finger rests against the underside of the flat bottom of the plate's container depression thus providing firm support for the heaviest weight on the plate.

2. A three dimensional circular plate approximately eleven inches in diameter designed to hold items of food and beverage and to be held in one hand of an adult person, said plate having (1) a cylindrical outer edge, (2) a flat planar upper surface which surface is broken by at least two food depressions in the plate for holding items of food and one cylindrical flat bottomed container depression sized to firmly hold a container of liquid refreshment, and (3) a thumb hole located closely adjacent to the container depression, said thumb hole sized and oriented to receive from below the plate the thumb of the left hand of an adult person so that the largest knuckle of the person's index finger of the left hand rests against the underside of the flat bottom of the plate's container depression thus providing firm support for the heaviest weight on the plate.

3. The plate according to claim 2 wherein the bottom inner surface of the container depression has a raised center for promoting the collection of condensation along the outer edge of the bottom inner surface.

4. The plate according to claim 2 wherein the planar upper surface includes a plurality of said food depressions.

5. The plate according to claim 2 wherein the bottom inner surface of the container depression has a convex shape for promoting the collection of condensation along the outer edge of the bottom inner surface of the container depression.

6. The plate according to claim 2 wherein the container depression is located adjacent to one of the food depressions.

7. The plate according to claim 2 wherein the planar surface further includes at least one toothpick holding hole.

8. The plate according to claim 2 wherein the planar surface further includes at least one utensil holding hole.

9. The plate according to claim 2 wherein the planar surface further includes at least one napkin holding slot in the plate's exterior edge.

10. The plate according to claim 2 wherein the placement of the thumb hole reduces the downward vertical pressure of the plate on the base of the user's thumb and stabilizes the plate.

11. The plate according to claim 2 wherein the placement of the thumb hole and the beverage container depression adjacent to that portion of the outer edge of the plate lying above the wrist of the person minimizes the torsional forces along the longitudinal axis of the hand.

12. The plate according to claim 2 wherein the placement of the thumb hole closely adjacent to the beverage container depression and to the outer edge of the plate reduces the torsional forces along the axis of the hand which lies perpendicular to the longitudinal axis of the hand.

13. The plate according to claim 2 wherein the container depression has an outer edge and an inner edge, the container depression's outer edge located adjacent to the plate's outer edge and the container depression's inner edge located internally within the plate.

14. The plate according to claim 13 wherein the thumb hole is located closely adjacent to the container depression's inner edge.

15. The plate according to claim 2 wherein the plate has a longitudinal axis extending between two of the food depressions.

16. The plate according to claim 15 wherein the thumb hole has a longitudinal axis angularly displaced from and intersecting the plate's longitudinal axis approximately at the plate's cylindrical outer edge.

17. A plate for supporting foods, beverages, and accessories to be held in one hand of an adult person, comprising a substantially planar support surface having a longitudinal axis and defined by a peripheral edge;

at least one recessed compartment in the support surface for containing food, said compartment defined by a bottom surface and by a peripheral surface having a lower end connected to said bottom surface and an upper end connected to said support surface, a recessed beverage container compartment in the support surface for holding beverage containers, said recessed beverage container compartment positioned in the support surface displaced from the longitudinal axis, said beverage container compartment defined by a bottom surface and by a peripheral surface having a lower end connected to said bottom surface and the upper end connected to the support surface; and an aperture in the support surface displaced from the at least one recessed compartment to one side of the longitudinal axis and positioned between said recessed beverage container compartment and the longitudinal axis sized to receive from below the plate the thumb of an adult person, the displacement of said aperture from a point in the bottom of said recessed beverage container compartment equal to approximately the length of the hand of the person between the largest knuckle of the index finger and the largest knuckle of the thumb.

18. A method for producing a three dimensional circular plate designed to hold food and beverage and to be held in one hand of a person comprising producing a plate having a flat planar upper surface which surface is broken by at least one depression for holding various items of food and one cylindrical flat bottomed container depression sized to hold a cylindrical beverage container, and a thumb hole located adjacent the edge of the plate and closely adjacent to the container depression, sizing and orienting said thumb hole to receive from below the plate the thumb of the person's hand so that the largest knuckle of the index finger rests against the underside of the flat bottom of the plate's container depression thus providing firm support for the weight of the cylindrical container and its contents.

* * * * *

US005607077B1

REEXAMINATION CERTIFICATE (4035th)

United States Patent [19] [11] B1 5,607,077

Torkelson [45] Certificate Issued Apr. 11, 2000

[54] FOOD BEVERAGE AND ACCESSORIES PLATE

[76] Inventor: Torkel E. Torkelson, 1961 River Reach Dr. Suite 207, Naples, Fla. 33942

Reexamination Request:
No. 90/005,083, Aug. 24, 1998

Reexamination Certificate for:

| | |
|---|---|
| Patent No.: | **5,607,077** |
| Issued: | **Mar. 4, 1997** |
| Appl. No.: | **08/645,913** |
| Filed: | **May 14, 1996** |

Related U.S. Application Data

[63] Continuation of application No. 08/234,589, Apr. 21, 1994, abandoned, which is a continuation of application No. 08/001,097, Jan. 6, 1993, abandoned, which is a continuation-in-part of application No. 07/698,901, May 13, 1991, abandoned.

[51] Int. Cl.[7] ..... A47G 19/00

[52] U.S. Cl. ..... 220/575; 220/556; 220/735; 220/737; 206/217; 206/542; D7/507; D7/543; D7/546; D7/549; D7/555

[58] Field of Search ..... 220/575, 23.8, 220/23.83, 556, 555, 735, 737, 738, 739, 915.1; 206/217, 542, 549; D7/543, 544, 546, 549, 553, 555

[56] References Cited

U.S. PATENT DOCUMENTS

| | | | |
|---|---|---|---|
| D. 182,396 | 4/1958 | Berry, Jr. | D7/549 |
| 3,018,014 | 1/1962 | Opolion | 215/100.5 |
| 4,219,144 | 8/1980 | Hagelberg | 6/563 X |
| 4,461,396 | 7/1984 | Harper | 220/23.83 |
| 4,607,758 | 8/1986 | Stevens | 220/23.83 |
| 5,152,398 | 10/1992 | Forestal et al. | 206/561 |

*Primary Examiner*—Stephen K. Cronin

[57] ABSTRACT

A hand-held, self-contained support plate for carrying or serving foods and beverages and for carrying accessories such as utensils, toothpicks, and napkins is disclosed. The plate includes a planar support surface into which are recessed a main compartment and side compartment for receiving foods, a sauce compartment for receiving sauces, condiments, and the like, and a beverage compartment having a raised peripheral edge for increasing support for the beverage container. The plate includes an aperture through which the user inserts a thumb to grip the plate, the aperture being placed so as to enable the user to avoid harmful contact with hot or cold materials supported by the plate and to allow a knuckle of the index finger of the hand to support the beverage container compartment and promote stability of the plate. The plate further includes holes into which toothpicks may be inserted to be held until used and a slot in the peripheral edge of the planar support surface into which napkins may be removably placed. The plate also includes a slot vertically disposed in the plate into which utensils may be inserted to be held until required for use.

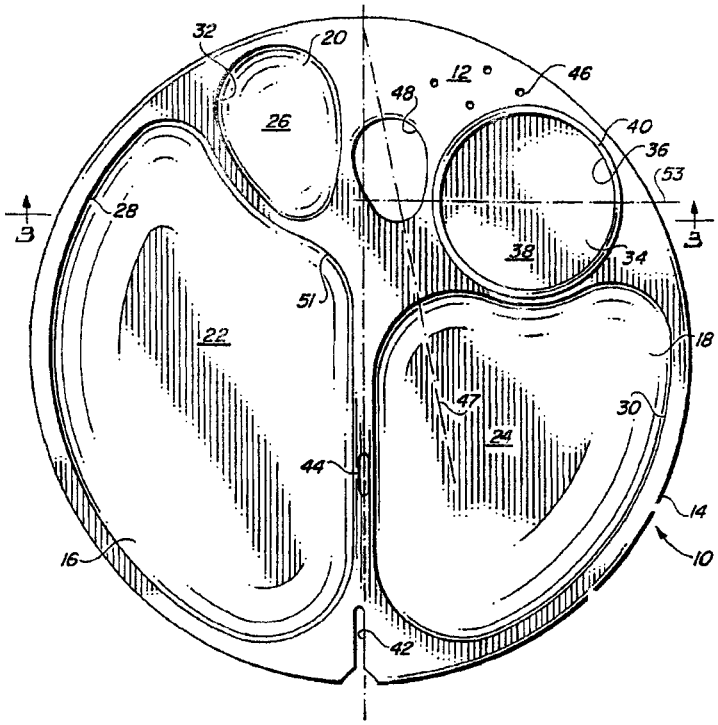

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 2, 17 and 18 are determined to be patentable as amended.

Claims 3–16, dependent on an amended claim, are determined to be patentable.

1. A three dimensional plate designed to hold items of food and beverage and to be held in one hand of an adult person, said plate having (1) a flat planar upper surface which surface is broken by at least one food depression in the plate for holding items of food and one cylindrical flat bottomed container depression sized to firmly hold a container of liquid refreshment, and (2) a thumb hole located closely adjacent to *and partially forward of a horizontal axis of* the container depression, *said horizontal axis being displaced 90° from a longitudinal axis of the plate,* said thumb hole [sized and oriented] *having a longitudinal axis which is angularly displaced from a longitudinal axis of the plate and does not pass through the beverage compartment in order* to receive from below the plate the thumb of the hand of an adult person so that *the thumb does not extend into the beverage compartment and* the largest knuckle of the person's index finger rests against the underside of the flat bottom of the plate's container depression thus providing firm support for the heaviest weight on the plate.

2. A three dimensional circular plate approximately eleven inches in diameter designed to hold items of food and beverage and to be held in one hand of an adult person, said plate having (1) a cylindrical outer edge, (2) a flat planar upper surface which surface is broken by at least two food depressions in the plate for holding items of food and one cylindrical flat bottomed container depression sized to firmly hold a container of liquid refreshment, and (3) a thumb hole located closely adjacent to *and partially forward of a horizontal axis of* the container depression, said horizontal axis being displaced 90° from a longitudinal axis of the plate, said thumb hole [sized and oriented] *having a longitudinal axis which is angularly displaced from a longitudinal axis of the plate and does not pass through the beverage compartment in order* to receive from below the plate the thumb of the hand of an adult person so that *the thumb does not extend into the beverage compartment and* the largest knuckle of the person's index finger rests against the underside of the flat bottom of the plate's container depression thus providing firm support for the heaviest weight on the plate.

17. A plate for supporting foods, beverages, and accessories to be held in one hand of an adult person, comprising a substantially planar support surface having a longitudinal axis and defined by a peripheral edge;

at least one recessed compartment in the support surface for containing food, said compartment defined by a bottom surface and by a peripheral surface having a lower end connected to said bottom surface and an upper end connected to said support surface, a recessed beverage container compartment in the support surface for holding beverage containers, said recessed beverage container compartment positioned in the support surface displaced from the longitudinal axis, said beverage container compartment defined by a bottom surface and by a peripheral surface having a lower end connected to said bottom surface and the upper end connected to the support surface; and an aperture in the support surface displaced from the at least one recessed compartment to one side of the longitudinal axis *and partially forward of a horizontal axis of the beverage container compartment, said horizontal axis being displaced 90° from the longitudinal axis of the plate, said aperture having a longitudinal axis which is angularly displaced from the longitudinal axis of the plate and does not pass through the beverage container compartment,* and *said aperture* positioned between said recessed beverage container compartment and the longitudinal axis sized to receive from below the plate the thumb of an adult person, the displacement of said aperture from a point in the bottom of said recessed beverage container compartment equal to approximately the length of the hand of the person between the largest knuckle of the index finger and the largest knuckle of the thumb.

18. A method for producing a three dimensional circular plate designed to hold food and beverage and to be held in one hand of a person comprising producing a plate having a flat planar upper surface which surface is broken by at least one depression for holding various items of food and one cylindrical flat bottomed container depression sized to hold a cylindrical beverage container, and a thumb hole located adjacent the edge of the plate and closely adjacent to *and partially forward of a horizontal axis of* the container depression, *said horizontal axis being displaced 90° from a longitudinal axis of the plate,* sizing and orienting said thumb hole *so that a longitudinal axis of the thumb hole is angularly displaced for the longitudinal axis fo the plate and does not pass through the container depression so that the thumb does not extend into the beverage compartment and* to receive from below the plate the thumb of the person's hand so that the largest knuckle of the index finger rests against the upperside of the flat bottom of the plate's container depression thus providing firm support for the weight of the cylindrical container and its contents.

* * * * *